United States Patent [19]

Buffington et al.

[11] Patent Number: 4,583,648

[45] Date of Patent: Apr. 22, 1986

[54] ANGULARLY ADJUSTABLE SHELF AND SUPPORT

[75] Inventors: Jesse D. Buffington, Trenton, Ga.; Bruce Young, III, Chattanooga, Tenn.

[73] Assignee: Stainless Metal Products, Inc., Chattanooga, Tenn.

[21] Appl. No.: 294,638

[22] Filed: Aug. 20, 1981

[51] Int. Cl.[4] ..... A47F 5/08

[52] U.S. Cl. ..... 211/90; 248/242; 211/106

[58] Field of Search ..... 211/89, 90, 106, 150, 211/153; 248/242, 558, 225.2

[56] References Cited

U.S. PATENT DOCUMENTS

| | | | |
|---|---|---|---|
| 710,780 | 10/1902 | Hutchens | 248/242 |
| 2,008,091 | 7/1935 | Betts | 211/153 X |
| 2,136,109 | 11/1938 | Kress | 248/242 X |
| 2,172,881 | 9/1939 | Swedman et al. | 248/242 X |
| 2,176,772 | 10/1939 | Smith et al. | 248/242 X |
| 2,717,189 | 9/1955 | Teague et al. | 211/153 X |
| 3,346,226 | 10/1967 | Shell | 248/242 |
| 3,417,872 | 12/1968 | Close | 248/242 X |
| 3,463,433 | 8/1969 | Stein et al. | 211/150 X |
| 3,538,860 | 11/1970 | Fisher | 248/242 X |
| 3,602,472 | 8/1971 | Smyth-Tyrrell | 248/242 |
| 3,973,678 | 8/1976 | Nesbitt | 211/106 |
| 4,008,873 | 2/1977 | Travaglio et al. | 248/242 |
| 4,344,540 | 8/1982 | Marschak | 211/87 X |

FOREIGN PATENT DOCUMENTS

| | | | |
|---|---|---|---|
| 674989 | 11/1964 | Italy | 248/242 |
| 176921 | 10/1956 | Sweden | 248/242 |
| 373533 | 11/1963 | Switzerland | 248/242 |
| 957329 | 5/1964 | United Kingdom | 248/242 |
| 965389 | 7/1964 | United Kingdom | 248/242 |

*Primary Examiner*—William E. Lyddane
*Assistant Examiner*—Peter A. Aschenbrenner
*Attorney, Agent, or Firm*—Shoemaker and Mattare, Ltd.

[57] ABSTRACT

A shelf and support therefor are angularly adjustable with respect to a wall, or the like. The shelf and support are also adjustable in a plane which is parallel to the wall, or the like.

1 Claim, 15 Drawing Figures

ANGULARLY ADJUSTABLE SHELF AND SUPPORT

BACKGROUND OF THE INVENTION

The present invention relates, in general, to shelving, and, more particularly, to adjustable shelving.

While adjustable shelving is known, the present inventors are not aware of any shelving which is adjustable with three degrees of freedom. That is, the inventors are not aware of any shelving that is adjustable in a plane parallel to a supporting surface and also angularly with respect to that supporting surface.

SUMMARY OF THE INVENTION

The shelf means embodying the teachings of the present invention has means for adjusting the position of that shelf in a plane which is parallel to the supporting surface as well as means for adjusting the angular orientation of that shelf with respect to that supporting surface.

The angular adjustment feature permits the shelf means to adapt to a wide variety of situations.

The shelf support arm of the present invention acts as an end gate to prevent items stored on the shelf from sliding off the shelf; however, the arm still permits viewing of these items.

The shelf and arms of the present invention are collapsible and thus are easily nested together for shipping and/or storing.

The shelf arm can be attached to a shelf to suppport that shelf from above, thereby adding versatility to the device. The shelf arm is releasably attachable to a shelf body so that shelf bodies and arms can be interchanged, thereby adding still more versatility to the device.

OBJECTS OF THE INVENTION

It is a main object of the present invention to provide a shelf and a shelf support arm bracket with at least three degrees of adjustment freedom.

It is another object of the present invention to provide a shelf means with an angular adjustment capability.

It is still another object of the present invention to provide a shelf means which is adaptable to a wide variety of shelf styles.

These together with other objects and advantages which will become subsequently apparent reside in the details of construction and operation as more fully hereinafter described and claimed, reference being had to the accompanying drawings forming part hereof, wherein like reference numerals refer to like parts throughout.

BRIEF DESCRIPTION OF THE DRAWINGS

FIGS. 2–4 are elevation views showing various angular orientations of the shelf means embodying the teachings of the present invention with respect to a channel bracket supporting such shelf on a wall or the like.

FIGS. 8–10 are elevation views showing various angular orientations of the FIG. 7 shelf means with respect to a channel bracket supporting such a shelf means on a wall or the like.

DETAILED DESCRIPTION OF THE INVENTION

Figure 1:
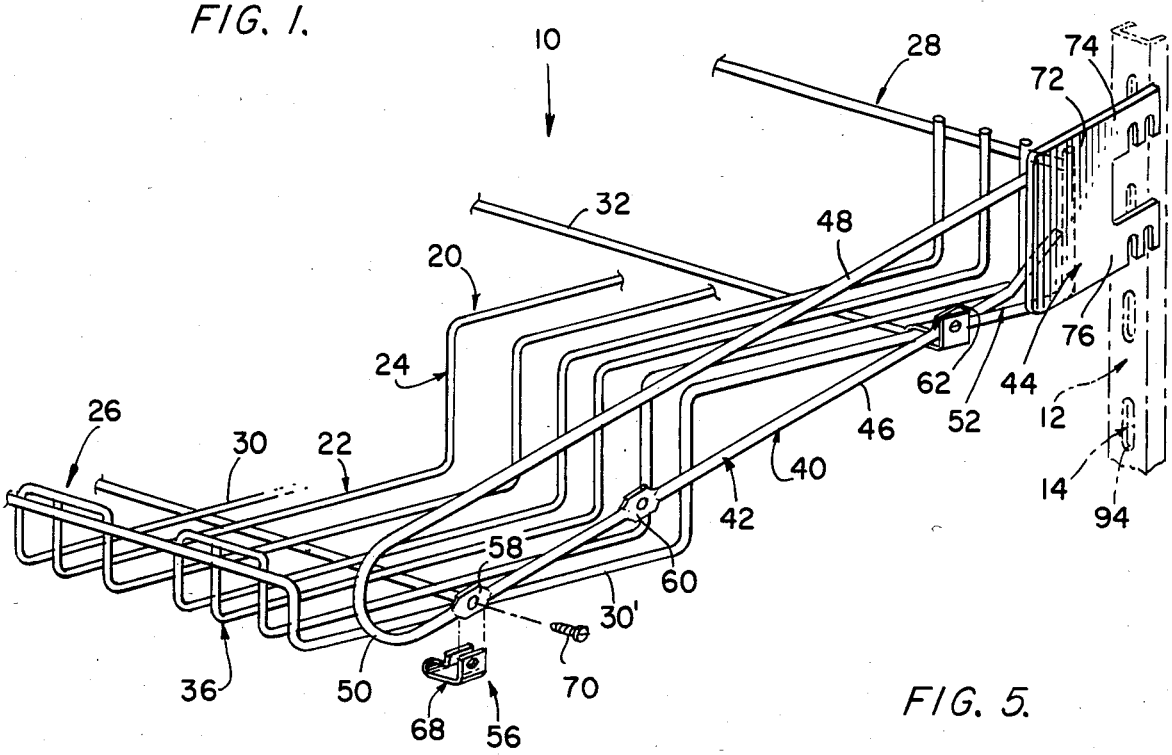
FIG. 1 is a perspective of a shelf means embodying the teachings of the present invention.
Figure 5:
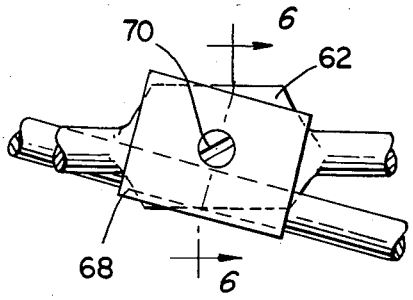
FIG. 5 is a view taken along line 5—5 of FIG. 4.

Shown in FIGS. 1–6 is an angularly adjustable shelf means 10 embodying the teachings of the present invention. The shelf means is disengageably mounted on a channel bracket 12 which has oblong holes 14 defined longitudinally therein. The channel bracket is a wall standard commonly used to support shelving, and the like, and is attached to a wall or other such supporting structure by fasteners, or the like, as suitable.

The shelf means 10 is symmetric, and thus only one end thereof will be shown and described herein, it being understood that the other end is identical to the end shown and described herein.

The shelf means 10 includes a stepped body 20 having a plurality of levels 22 separated by a riser section 24 and bonded by distal end 26 and proximal end 28. The shelf body preferably includes a multiplicity of rods 30 and cross-rods 32. The rods are interconnected in groups, as shown by the reference indicator 36 in the preferred embodiment. While rods are disclosed herein, any other forms of the body, such as sheet metal, baskets, prong bars, pocket assemblies, or the like, and ungrouped rods can be used without departing from the scope of the present disclosure.

Shelf body support arms 40 are located on each end of the body. Preferably, the arms are made of wire and sheet metal combined, and each support arm includes a U-shaped body 42 with a support plate 44 on the proximal end thereof. The body 42 includes leg forming rods 46 and 48 and bight section 50. Leg 46 includes an offset 52 to make that leg flexible enough to fit a wide variety of items. The support arms are coupled to the body 20 by fastener members 56, each of which includes flats 58, 60 and 62 on leg 46 of the arm and are coupled to the outermost rod 30'. Clamps 68 and 70 couple the flats 58 and 62 to the flats 64 and 66 on the arm 30'. A plurality of flats are defined on the support arm so that various shelves and/or shelf positions can be defined by coupling the shelf body to appropriate flats on the support arm, and so that the body 20 can be replaced by an alternative form of the body, which will be discussed below. As will also be discussed below, the fastener members 56 are included in an overall angular adjustment means for the shelf means 10.

The support plate 44 includes a planar body 72 having a pair of arms 74 and 76 extending outwardly therefrom. The arms 74 and 76 are spaced apart from each other a distance corresponding to the spacing between the holes 14 on the wall standard 12 so that these arms can be accommodated in the holes 14 as shown in the figures.

The shelf angular adjustment means further includes a plurality of notches defined in corresponding edges of the plate arms 74 and 76. Thus, notches 80 and 82 are defined in side edge 84 of the arm 74 and notches 86 and 88 are defined in side edge 90 of the leg 76. The notches all open in a common direction as indicated in the figures so that these notches can engage selected edges of the hole defining periphery of the channel bracket.

The notches are aligned so that notches 80 and 86 are in alignment with each other, as are notches 82 and 88. Of course, notches 80 and 88 and 82 and 86 are not in alignment with each other.

As shown in FIG. 1, the arms 74 and 76 are received in selected holes 14 so that one notch from each arm is engaged against peripheral edge 94 defining each of the holes 14. The support plate 44, and hence the shelf, is thus coupled to a wall, or other such member, via the channel bracket.

Figure 2:
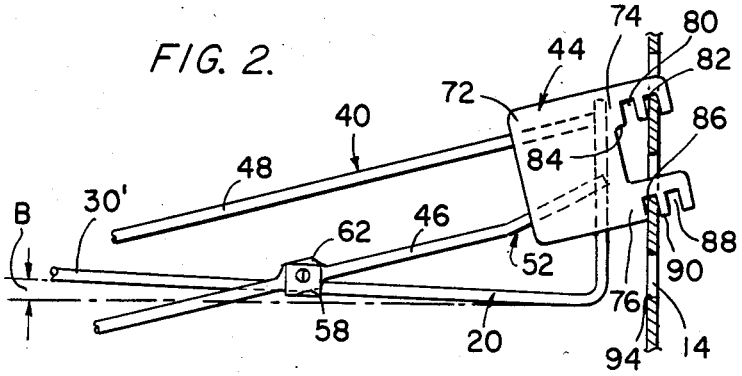
Figure 3:
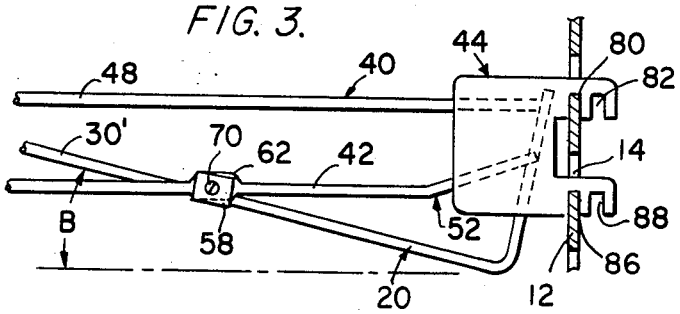
Figure 6:
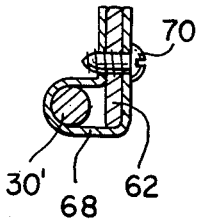
FIG. 6 is a view taken along line 6—6 of FIG. 5.
Figure 4:
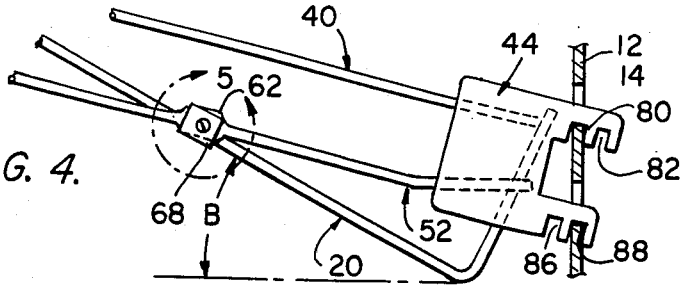
Figure 7:
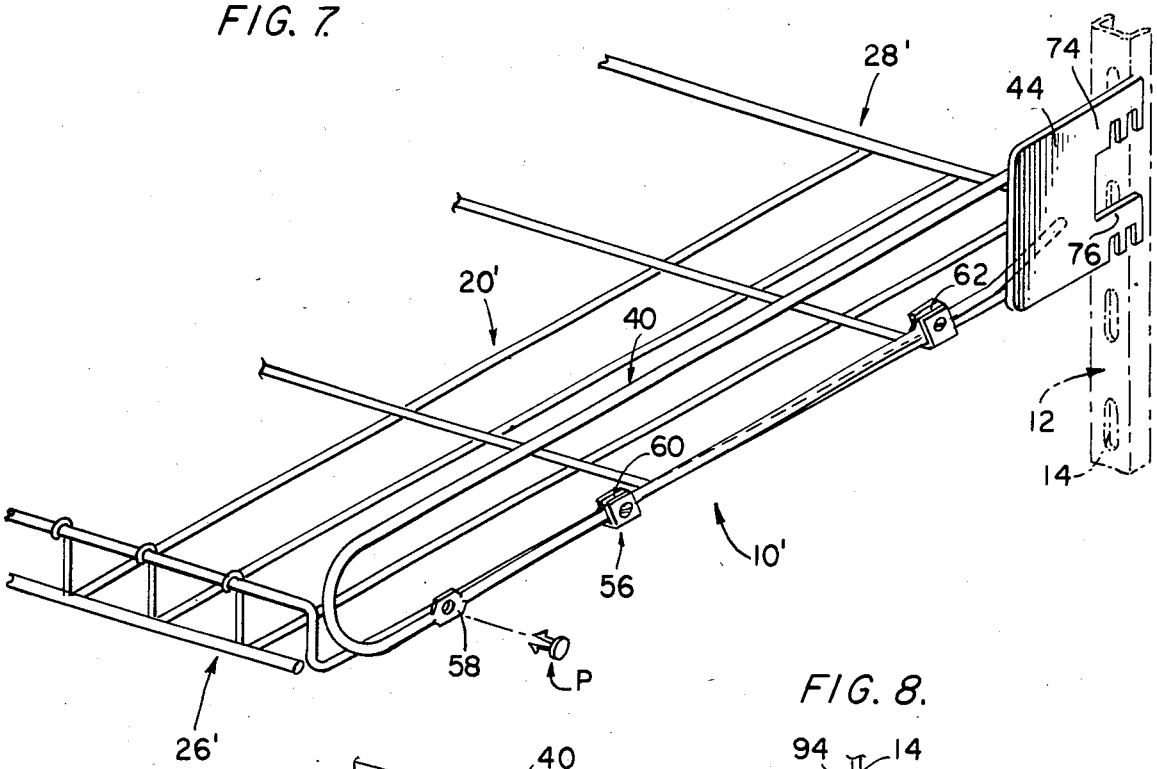
FIG. 7 is a perspective of an alternative embodiment of the shelf means embodying the teachings of the present invention.

As shown in FIGS. 2, 3 and 4, the angle of the shelf support arm 40 with respect to the channel bracket 12, and hence with respect to a wall, is represented by the indicator B, and is variable by varying the notches used to engage the peripheral edges 94 of the holes 14. It is also noted that the body 20 has an initial angle with respect to the arm 40. In the preferred embodiment, the angle B equals 2° (notches 82 and 86 engaged in holes 14 in FIG. 2, 14° in FIG. 3 (notches 80 and 86 engaged in holes 14), and 28° in FIG. 4 (notches 80 and 88 engaged in holes 14). The 2° upward tilt is defined by the angular supporting position of the shelf body 20 with respect to the shelf support arm 40 so that the shelf body assumes the 2° tilt while the plate 44 is extending outwardly at an angle with respect to the wall bracket 12 as shown in FIG. 2.

An alternative form of the shelf means 10 is indicated in FIGS 7–10 and shelf means 10' includes shelf body 20'. The body 20' is planar between the proximal end 28' and the distal end 26', and is coupled to the shelf support arms 40 by fastener members 56 in an angular manner similar to the manner in which body 20 is coupled to the support arms 40 in shelf means 10 to define a pre-mounting tilt of about 2° with respect to the bracket 44. Thus, the shelf bodies 20 and 20' are interchangeable. It is noted that the flats 60 and 62 on the arm 40 are used to couple the body 20' to that arm.

A plastic snaplock P can also be used to attach the shelf body to the support arm in any embodiment of the present invention.

Figure 8:
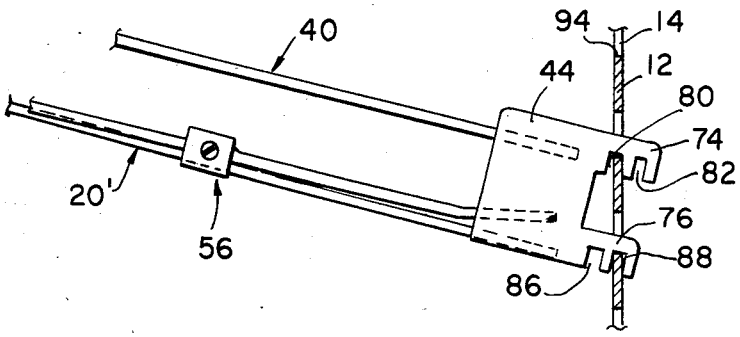
Figure 9:
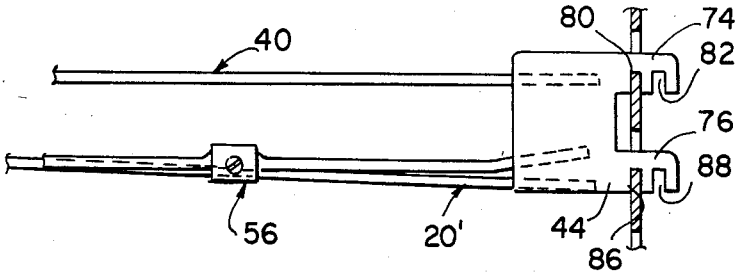
Figure 10:
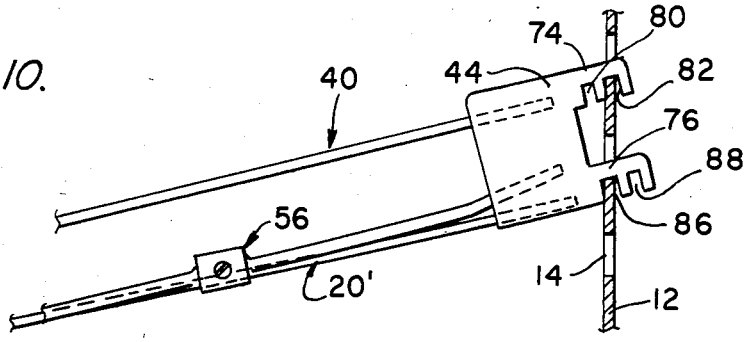

The angular orientation of the shelf means 10' is indicated in FIGS. 8–10 and assumes an angle B' with respect to the channel bracket, and hence with respect to the wall, or other such mounting element. Angle B' equals 2° in FIG. 9, 14° in FIG. 8 and 28° in FIG. 10.

By appropriately attaching arm 40 to plate 44, the angle B' can be adjusted so that the shelf 20' assumes any suitable orientation such as, for example, horizontal, 2° downwardly, 4° downwardly, or the like.

The arms 40 can also be folded outwardly or inwardly of the shelf so the entire assembly is essentially planar for storage, shipping or the like. Furthermore, the arms can be removed for storage, shipping, or the like.

Figures 11, 12:
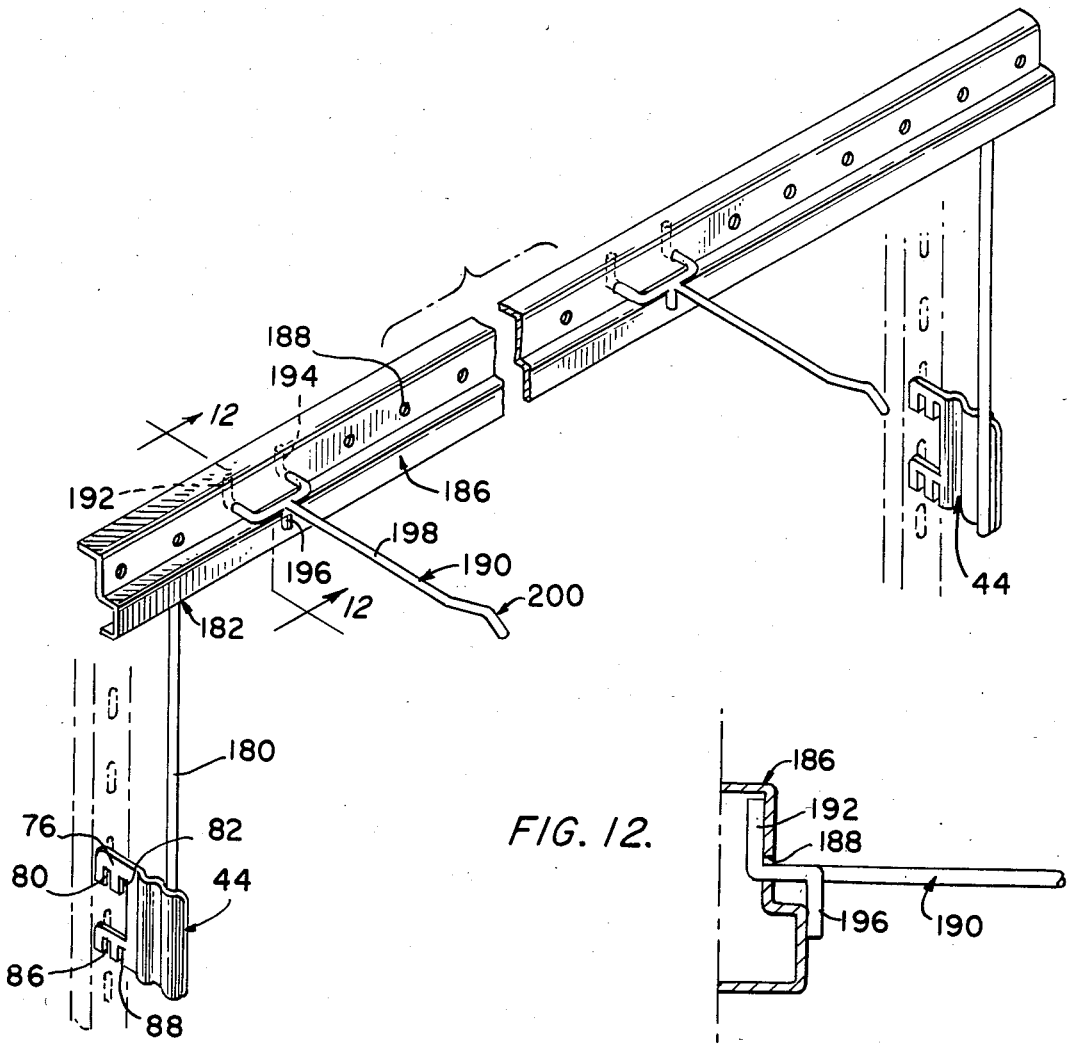
FIG. 11 is a perspective of an alternative embodiment of the present invention.
FIG. 12 is a view taken along line 12—12 of FIG. 11.

A further alternative embodiment of the present invention is shown in FIGS. 11 and 12 and includes a support plate 44 having a bar 180 attached thereto, as by welding or the like, to extend upwardly with respect to a mounted plate 44. Outer end 182 of the bar 180 is attached, as by welding, or the like, to a bracket 186 having holes 188 defined therein to be spaced apart longitudinally of that bracket. Prong supports 190 are releasably attached to the bracket via the holes 188 to extend outwardly of the bracket as shown in FIGS. 11 and 12. The prong supports include legs 192, 194 and 196 and body 198 having a bent section 200 thereon. The prong members are used to support special items, and the three degrees of freedom provided by support plate 44, as above discussed, adds versatility to such display.

Figure 13:
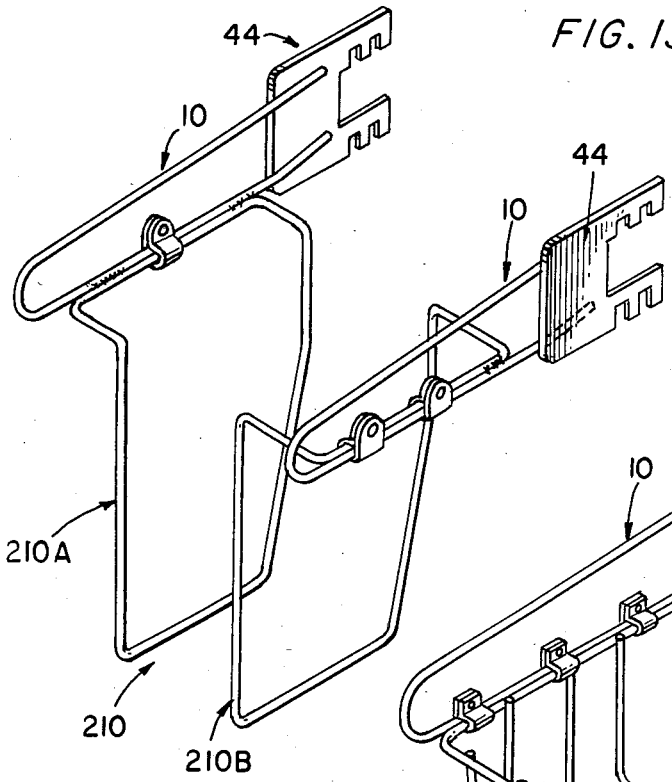
FIG. 13 is a perspective of an alternative embodiment of the present invention.

A pocket 210 is shown in FIG. 13 in conjunction with an arm 10. This pocket will be adjustable and thus have a wide variety of adaptations available to it. As known to those skilled in the art, pockets are suitable for displaying hosiery, toys, lightweight books, soft goods or the like. The pocket is adjustable to accommodate a wide variety of item widths. Means, such as welding, non-slip clips, or the like, can also be included to connect the pocket parts 210A and 210B to the arm 40 in a manner which prevents rotation thereof about arms 40. Alternatively, the pocket can be affixed directly to the plates 44, if so desired, or cross bars can be used to interconnect parts 210A and 210B, if so desired. For the sake of example, welds and clips are shown in FIG. 13.

Figure 14:
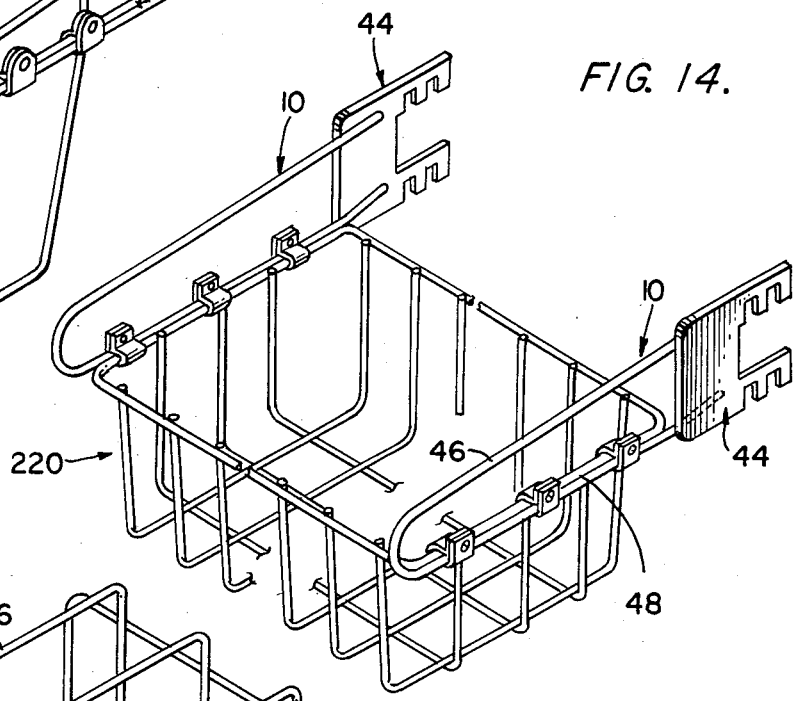
FIG. 14 is a perspective of an alternative embodiment of the present invention.

A basket 220 is shown in FIG. 14 in conjunction with an arm 10. The basket can accommodate small packages, or the like. As above, the basket is prevented from rotating with respect to the arm. Alternatively, a rod can be used in place of arms 46 and 48 or the basket can be directly attached to the plate 44.

Figure 15:
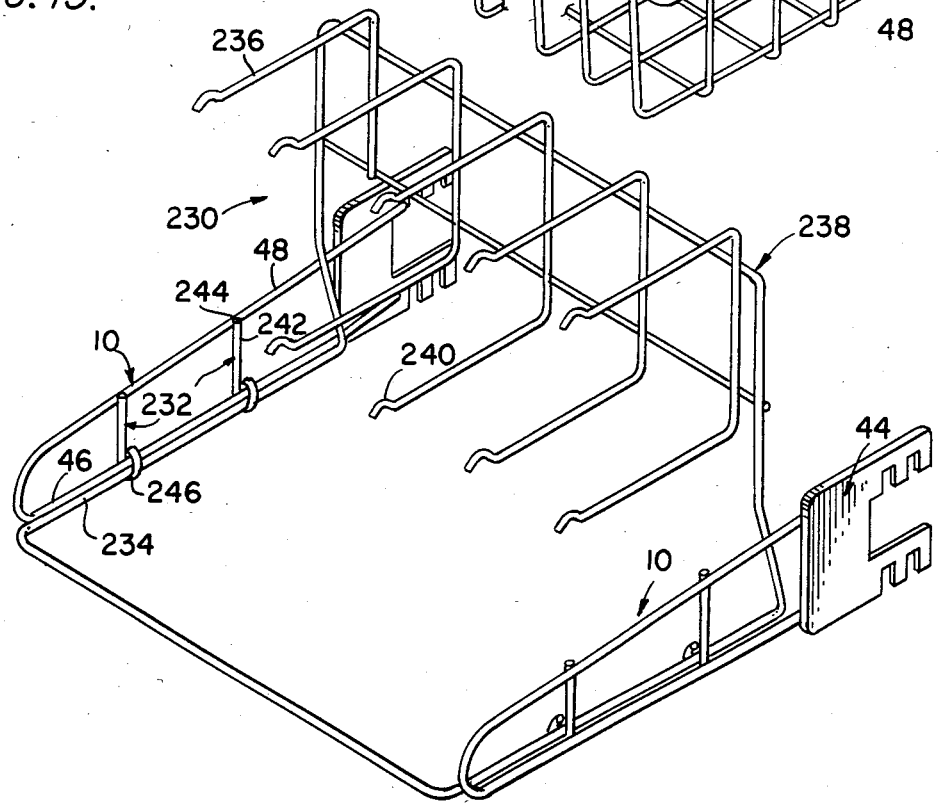
FIG. 15 is a perspective of an alternative embodiment of the present invention.

A prong member 230 is shown in FIG. 15 in conjunction with an arm 10. The arm 10 is attached by J-hooks 232 to the bottom leg 234 of the member and a plurality of prongs 236 are mounted on a back 238 to extend outwardly of that back. The prongs have bent sections 240 and are suitable for supporting a wide vareity of items, and the J-hooks include a one-piece body 242 having one end 244 attached, as by welding or the like, to leg 48 of the arm, and a bent section 246 bent around leg 46 of the arm and bottom leg 234 of the prong member. The J-hooks can be used with any embodiment of the present invention, if so desired. The FIG. 13 embodiment can be used to support the prong member 230, if so desired.

It is noted that arms 10' and/or 160 can be used with the pocket 210, the basket 220 and/or the prong member 230 if so desired. These alternative embodiments are also adjustable with three degrees of freedom as above-discussed.

It is noted that the above-discussed values for angles B and B' are preferred, but other values can be used without departing from the scope of the present invention.

As this invention may be embodied in several forms without departing from the spirit or essential characteristics thereof, the present embodiment is, therefore, illustrative and not restrictive, since the scope of the invention is defined by the appended claims rather than by the description preceding them, and all changes that fall within the metes and bounds of the claims or that form their functional as well as conjointly cooperative equivalents are, therefore, intended to be embraced by those claims.

What is claimed is:

1. An angularly adjustable shelf device comprising:

a pair of support arms each of which includes a plurality of projections, said projections being received in holes defined in a pair of wall brackets mounted on a wall to couple said support arms to said wall;

angular adjustment means on said support arms, said angular adjustment means including notches defined in each of said projections, with notches in one of said projections being aligned with corresponding notches in another of said projections;

said notches of the respective projections engaging the respective wall brackets at the periphery of the bracket holes defined therein to couple each of said support arms to the respective wall brackets;

notches from each projection engaging said wall bracket holes so that the angle of each of said support arms with respect to said respective wall brackets is adjustably set;

a support bracket having a plurality of spaced apart holes defined therein, each of said support arms including a rod connecting said angular adjustment means to said bracket;

prong support means releasably mounted on said support bracket;

said prong support means comprising a body portion having three legs at one end thereof for engagement with said support bracket, two of said legs mountable in adjacent holes of said plurality of spaced holes and the third leg resting against said support bracket, and a bent section at the other end of said body for supporting and holding articles thereon.

* * * * *